US010601196B2

(12) United States Patent
Asari et al.

(10) Patent No.: US 10,601,196 B2
(45) Date of Patent: Mar. 24, 2020

(54) TIP STRUCTURE OF FLAT WIRE AND METHOD FOR MANUFACTURING THE TIP STRUCTURE

(71) Applicant: SUMIDA CORPORATION, Tokyo (JP)

(72) Inventors: Tomoaki Asari, Natori (JP); Tomoyuki Kaneko, Natori (JP)

(73) Assignee: SUMIDA CORPORATION, Tokyo (JP)

( * ) Notice: Subject to any disclaimer, the term of this patent is extended or adjusted under 35 U.S.C. 154(b) by 0 days.

(21) Appl. No.: 16/249,313

(22) Filed: Jan. 16, 2019

(65) Prior Publication Data

US 2019/0252841 A1 Aug. 15, 2019

(30) Foreign Application Priority Data

Feb. 13, 2018 (JP) ..... 2018-022781

(51) Int. Cl.

| | |
|---|---|
| ***H01R 4/18*** | (2006.01) |
| ***H01R 43/048*** | (2006.01) |
| ***H01R 12/69*** | (2011.01) |
| ***H01B 7/08*** | (2006.01) |

(52) U.S. Cl.

CPC ..... *H01R 43/048* (2013.01); *H01B 7/08* (2013.01); *H01R 4/182* (2013.01); *H01R 12/69* (2013.01)

(58) Field of Classification Search

CPC ..... H01R 43/048; H01R 4/182

See application file for complete search history.

(56) References Cited

U.S. PATENT DOCUMENTS

| | | | | |
|---|---|---|---|---|
| 3,696,322 | A * | 10/1972 | Spangler | H01R 4/182 439/423 |
| 6,068,505 | A * | 5/2000 | Sai | H01R 12/69 439/422 |
| 6,375,492 | B1 * | 4/2002 | Hio | H01R 12/68 439/422 |
| 7,462,062 | B2 * | 12/2008 | Kumakura | H01R 4/182 439/422 |
| 9,033,732 | B2 * | 5/2015 | Hashiguchi | H01R 4/182 439/581 |
| 9,768,524 | B2 * | 9/2017 | Seipel | H01R 4/188 |
| 9,806,441 | B2 * | 10/2017 | Yoshioka | H01M 2/20 |

(Continued)

FOREIGN PATENT DOCUMENTS

| | | | |
|---|---|---|---|
| JP | 2000-077124 | A | 3/2000 |
| JP | 2004-319157 | A | 11/2004 |

(Continued)

OTHER PUBLICATIONS

Machined translation for JP 2014-170646, 9 pages (Year: 2019).*

(Continued)

*Primary Examiner* — Hung V Ngo
(74) *Attorney, Agent, or Firm* — Oliff PLC

(57) ABSTRACT

A slit having a predetermined width and a predetermined length is formed in a longitudinal direction from a middle of a distal edge of a tip of a flat wire. Next, one of a left strip and a right strip is brought upward and the other is brought downward, and then the left strip and the right strip vertically separated are laterally brought close to each other. Finally, the left strip and the right strip are vertically pressed to abut against each other.

14 Claims, 6 Drawing Sheets

(56) References Cited

U.S. PATENT DOCUMENTS

| | | | | |
|---|---|---|---|---|
| 9,887,036 | B2 * | 2/2018 | Kawashima | H01F 27/2828 |
| 10,085,340 | B2 * | 9/2018 | Ito | H01R 43/048 |
| 2008/0124547 | A1 * | 5/2008 | O | H01L 24/45 428/379 |
| 2011/0056747 | A1 * | 3/2011 | Matsushita | H01R 4/023 174/84 R |
| 2014/0318849 | A1 | 10/2014 | Ito | |
| 2014/0322993 | A1 * | 10/2014 | Ito | H01R 4/182 439/877 |
| 2014/0329394 | A1 | 11/2014 | Ito | |

FOREIGN PATENT DOCUMENTS

| | | | |
|---|---|---|---|
| JP | 2014-170646 | A | 9/2014 |
| JP | 2016-197681 | A | 11/2016 |

OTHER PUBLICATIONS

Jun. 4, 2019, Extended European Search Report issued in European Patent Application No. 18213916.2.
Dec. 12, 2019 Office Action issued in Korean Patent Application No. 10-2018-0149263.

* cited by examiner

PRIOR ART (V-SHAPED BENDING)

PRIOR ART (ROUND BENDING)

PRIOR ART (PUNCHING)

TIP STRUCTURE OF FLAT WIRE AND METHOD FOR MANUFACTURING THE TIP STRUCTURE

RELATED APPLICATION

This invention claims the benefit of Japanese Patent Application No. 2018-022781 filed on Feb. 13, 2018, which is hereby incorporated by reference.

BACKGROUND OF THE INVENTION

Field of the Invention

The present invention relates to a tip structure of a flat wire and a method for manufacturing the tip structure, and more particularly to a tip structure suitable for connecting a tip of a flat wire to a crimp terminal and a method for manufacturing the tip structure.

Description of the Prior Art

Flat wires usually have a lateral width larger than the diameter of the conductive wire insertion opening of the crimp terminal, and so, when attempting to connect a tip of a flat wire with the crimp terminal, it is difficult to connect them if the tip of flat wire retains its original form. In particular, since as small a crimp terminal as possible is preferably used in terms of cost and space-saving, the connection is further difficult.

Thus, in a conventional technique, a tip of a flat wire has been bent or punched to reduce a lateral width of the tip of the flat wire to be smaller than a diameter of a conductive wire insertion opening of a crimp terminal, and then insertion has been performed, thereby ensuring that the tip of the flat wire and the crimp terminal are crimped and coupled.

For example, as shown in FIG. 6, a tip 320 of a flat wire 310 is formed to have a V-shaped section (V-shaped bending: see Japanese Laid-Open Patent Publication No. 2004-319157), as shown in FIG. 7, a tip 420 of a flat wire 410 is formed to have an arcuate section (round bending), or as shown in FIG. 8, opposite sides of a tip 520 of a flat wire 510 are cut (punching: see Japanese Laid-Open Patent Publication No. 2016-197681), thereby reducing a width of a tip of a flat wire.

FIG. 9 is a perspective view of a general coil body 610 including a connection structure 611 of a flat wire tip 632 in a conventional technology in Patent Literature 2 mentioned below. As shown, the coil body 610 is configured so that one tip 632 of a flat wire 630 extending from a coil winding portion 620 is fitted in a cylindrical sleeve 641 that forms a crimp terminal 640, and in this state, a region between an inner protruding portion (for flat wire insertion stopper) 643 of the sleeve 641 and a flat wire insertion opening is crushed to connect the coil winding portion 620 and the sleeve 641.

As shown, the tip 632 of the flat wire 630 is punched to have a narrow portion 633 having a smaller width than a normal width of the flat wire 630, thereby allowing easy insertion of the tip 632 into the sleeve 641.

SUMMARY OF THE INVENTION

With increasing switching frequency in recent years, a flat wire as a coil conductive wire having a smaller thickness and a larger lateral width has been and will be more likely to be used.

However, bending a flat wire having a small thickness and a large lateral width as shown in FIG. 6 or 7 requires a plurality of steps, which increases labor and cost. For punching as shown in FIG. 8, if opposite sides of a tip are removed to reduce a lateral width so that a flat wire can be inserted into a conductive wire insertion opening of the crimp terminal, the flat wire having a small thickness may have a tip with a small width and thickness, which reduces tensile strength in a connection after crimping.

The present invention is achieved in view of such circumstances, and an object of the invention is to provide a tip structure of a flat wire and a method for manufacturing the tip structure, which, in the working of reducing a width of a tip of a conductive wire to allow the tip to be inserted into a conductive wire insertion opening of a crimp terminal, can reduce the number of steps of the process, prevent an increase in labor and cost, and prevent a reduction in tensile strength in a connection after crimping.

To achieve the object, a tip structure of a flat wire according to the present invention has a feature described below.

The present invention provides a tip structure of a flat wire that allows the flat wire to be inserted into a conductive wire insertion opening of a crimp terminal when the flat wire is connected to the crimp terminal, wherein the tip structure includes at least one slit formed over a predetermined length in a length direction from a distal edge of the tip, and at least two strips divided and formed by the slit overlap with each other.

It is preferable that in the tip structure of a flat wire, bases of the adjacent strips are spaced apart from each other.

Preferably, the bases of the adjacent strips abut against each other.

Preferably, the flat wire has a surface coated with an insulating coating.

The present invention provides a method for manufacturing a tip structure of a flat wire to be inserted into a conductive wire insertion opening of a crimp terminal when the flat wire is connected to the crimp terminal, wherein the method includes: forming at least one slit over a predetermined length in a length direction from a distal edge of the tip; and overlapping at least two strips formed by the slit with each other at least partially along a width on a distal side of the strips to form a strip overlapping portion.

Preferably, the slit has a predetermined width in a width direction of the flat wire.

Further, it is preferable that the slit is formed by any one of punching, cutting with laser radiation, and cutting with a rotary knife.

Preferably, both corners at a base of the slit are formed as rounded portions.

Preferably, the slit is formed to have no width by a cutting line extending in the length direction of the flat wire.

Preferably, a hole is formed continuously with an inner end of the slit.

It is preferable that before the at least two strips are overlapped with each other, one of the adjacent strips is pressed upward and the other is pressed downward so that the at least two strips are shifted from each other vertically in the flat wire by at least a thickness of the flat wire.

It is preferable that one of the adjacent strips is pressed upward and the other is pressed downward, and then the adjacent strips are laterally pressed to be close to each other.

Further, it is preferable that in laterally pressing the adjacent strips to be close to each other, bases of the adjacent strips are pressed toward a center by a first predetermined distance, and distal parts of the adjacent strips are pressed toward the center by a second predetermined distance.

Further, it is preferable that before the at least two strips are overlapped with each other, the at least two strips are twisted in the same direction around axes of the strips so that the strips are shifted from each other vertically in the flat wire by at least a thickness of the strips.

With the tip structure of a flat wire and the method for manufacturing the tip structure according to the present invention, at least one slit is formed over the predetermined length in the length direction from the distal edge of the tip to form the at least two strips, and the strips are vertically overlapped with each other, thereby reducing a lateral width of the tip of the flat wire.

Conventionally, V-shaped bending in FIG. 6 or round bending in FIG. 7 have been performed to reduce a lateral width. This requires multiple working steps, leading to an increase in labor and cost. The present invention does not require such shape forming with multiple steps, thereby reducing labor and cost in working the tip structure.

Also, performing punching in FIG. 8 has been known to reduce a lateral width of a flat wire. In this case, particularly for a flat wire having a small thickness, a sectional area of a tip decreases to reduce tensile strength. In the present invention, the strips are overlapped to increase a thickness of the tip, thereby ensuring a sectional area of the tip and ensuring tensile strength for the flat wire originally having a small thickness.

DESCRIPTION OF THE PREFERRED EMBODIMENTS

Now, a tip structure of a flat wire and a method for manufacturing the tip structure according to an embodiment of the present invention will be described with reference to the drawings. The tip structure of a flat wire of this embodiment is used, for example, as a tip structure of a flat wire when a flat wire and a crimp terminal are connected in various coil devices.

First, with reference to FIGS. 1A to 1C and 2, an outline of the method for manufacturing a tip structure of a flat wire of this embodiment will be described.

Figure 1A:
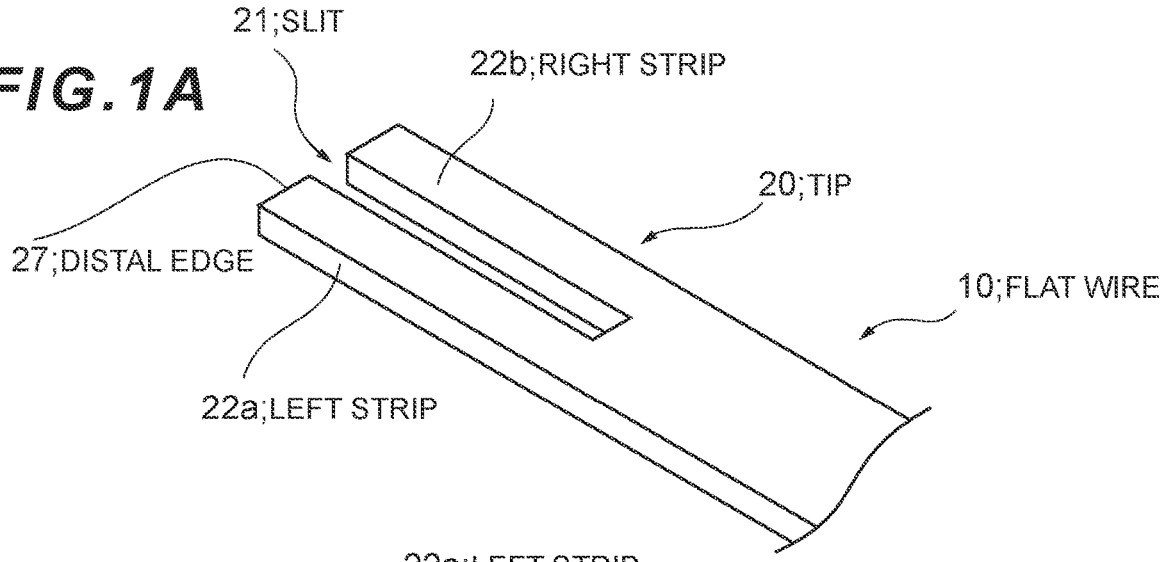
FIG. 1A shows a method for manufacturing a tip structure of a flat wire according to an embodiment of the present invention, and shows a step of providing a slit in a tip.
Figure 2:
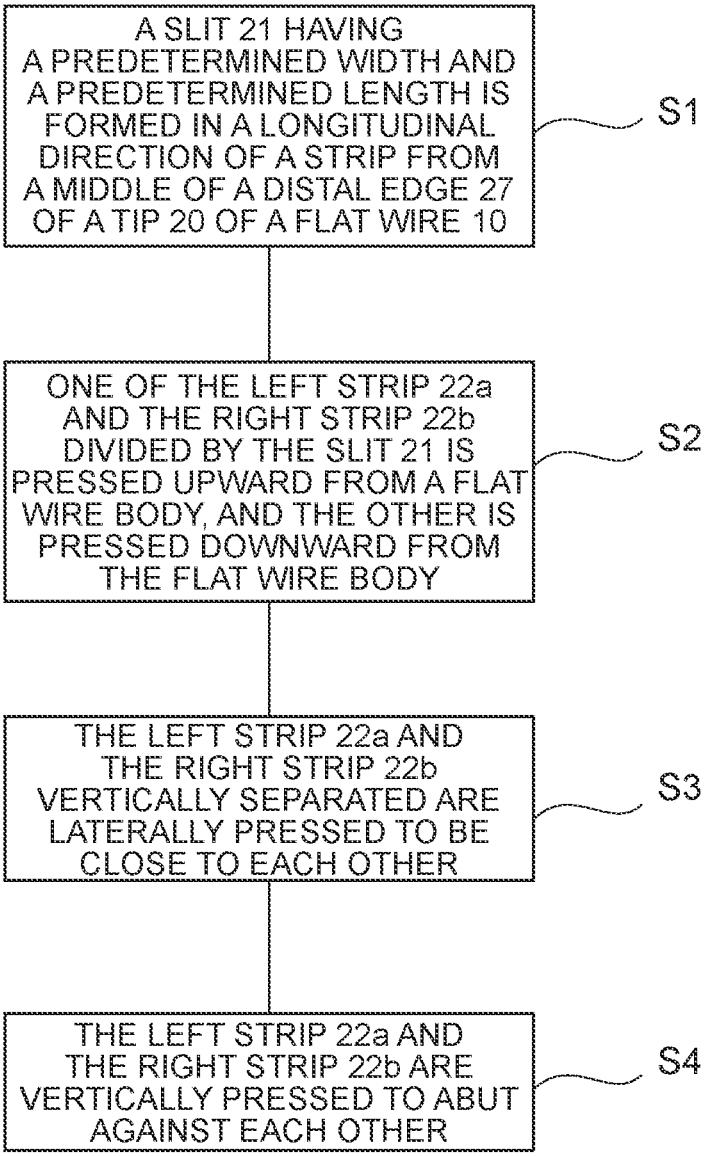
FIG. 2 is a flowchart of the method for manufacturing a tip structure of a flat wire according to an embodiment of the present invention.

As shown in FIG. 1A, a slit 21 having a predetermined width and a predetermined length is formed in a longitudinal direction of a strip from a middle of a distal edge 27 of a tip 20 of a flat wire 10 (see S1 in FIG. 2). The slit 21 is formed to divide the tip 20 into a left strip 22*a* and a right strip 22*b*. ("left" and "right" in the left strip 22*a* and the right strip 22*b* are relative. Here, according to an orientation shown in FIG. 1A, a strip shown on the left is referred to as the left strip 22*a*, and a strip shown on the right is referred to as the right strip 22*b*.)

Then, one of the left strip 22*a* and the right strip 22*b* divided by the slit 21 is pressed upward from a flat wire body (upward with respect to the plane of FIG. 1A), and the other is pressed downward from the flat wire body (downward with respect to the plane of FIG. 1A) (see S2 in FIG. 2). Thus, the left strip 22*a* and the right strip 22*b* are vertically shifted by a predetermined height. The predetermined height is equal to or larger than a thickness of the flat wire 10.

Figure 1B:
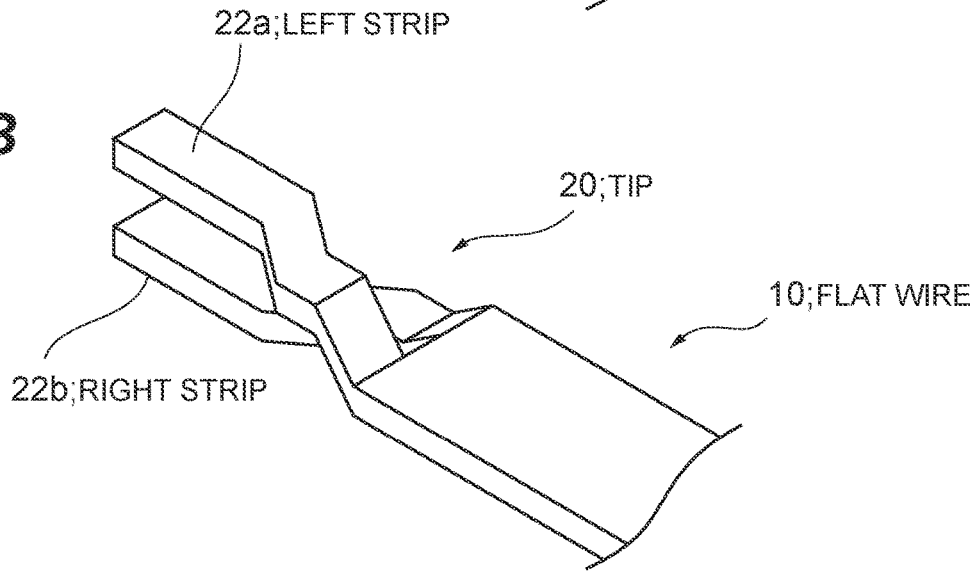
FIG. 1B shows the method for manufacturing a tip structure of a flat wire according to an embodiment of the present invention, and shows a step of vertically and laterally bending the tip so that left and right strips are vertically positioned.

Next, both of the left strip 22*a* and the right strip 22*b* vertically separated are pressed toward a center laterally between the left strip 22*a* and the right strip 22*b* to be close to each other (see S3 in FIG. 2). Thus, as shown in FIG. 1B, the left strip 22*a* is positioned just above the right strip 22*b* (the strips 22*a*, 22*b* are vertically positioned).

Figure 1C:
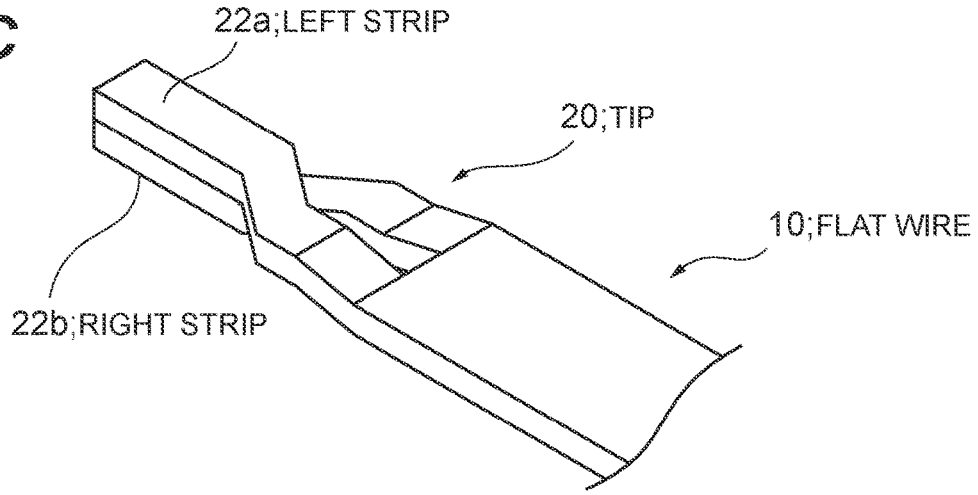
FIG. 1C shows the method for manufacturing a tip structure of a flat wire according to an embodiment of the present invention, and shows a step of vertically pressing the left and right strips to be close to each other.

Finally, as shown in FIG. 1C, the left strip 22*a* and the right strip 22*b* are vertically pressed to abut against each other (see S4 in FIG. 2).

The flat wire 10 is a conductive wire having a rectangular section (for example, made of copper), and has a surface coated with an insulating coating such as enamel.

The slit 21 can be formed by various methods. Specifically, for example, the slit 21 may be formed by punching, cutting with laser radiation, or cutting with a rotary knife using a grinder or the like. Punching is generally preferable because of a reduced number of steps and decrease in plastic shavings.

Thus, the tip structure of a flat wire according to the embodiment of the present invention (shown in FIG. 1C) can be formed.

Specifically, the tip structure of a flat wire of this embodiment is a structure of the tip 20 of the flat wire 10 that allows the flat wire 10 to be inserted into a conductive wire insertion opening 45 of a crimp terminal 40 (see FIG. 3) when the flat wire 10 is connected to the crimp terminal 40, in which the slit 21 is formed over a predetermined length in a length direction from the distal edge of the tip 20, and the left and right strips 22*a*, 22*b* divided and formed by the slit 21 overlap with each other.

The slit 21 has such a width that the strips 22*a*, 22*b* overlapped with each other can be inserted into the conductive wire insertion opening 45 of the crimp terminal 40 and that tensile strength can be ensured.

The slit 21 has preferably a length substantially equal to or slightly larger than a length of the tip 20 inserted into the conductive wire insertion opening 45 of the crimp terminal 40.

In this embodiment, as shown by the shape of the tip 20 in FIG. 1B, in a lateral pressing step, bases of the strips 22*a*, 22*b* are pressed toward a center by a predetermined distance, and distal parts of the strips 22*a*, 22*b* are pressed toward a center of the flat wire by the remaining distance. These two pressing steps can be simultaneously performed for an efficient operation.

However, such a lateral pressing process may be performed stepwise in the above two steps or in three or more steps.

Figure 3:
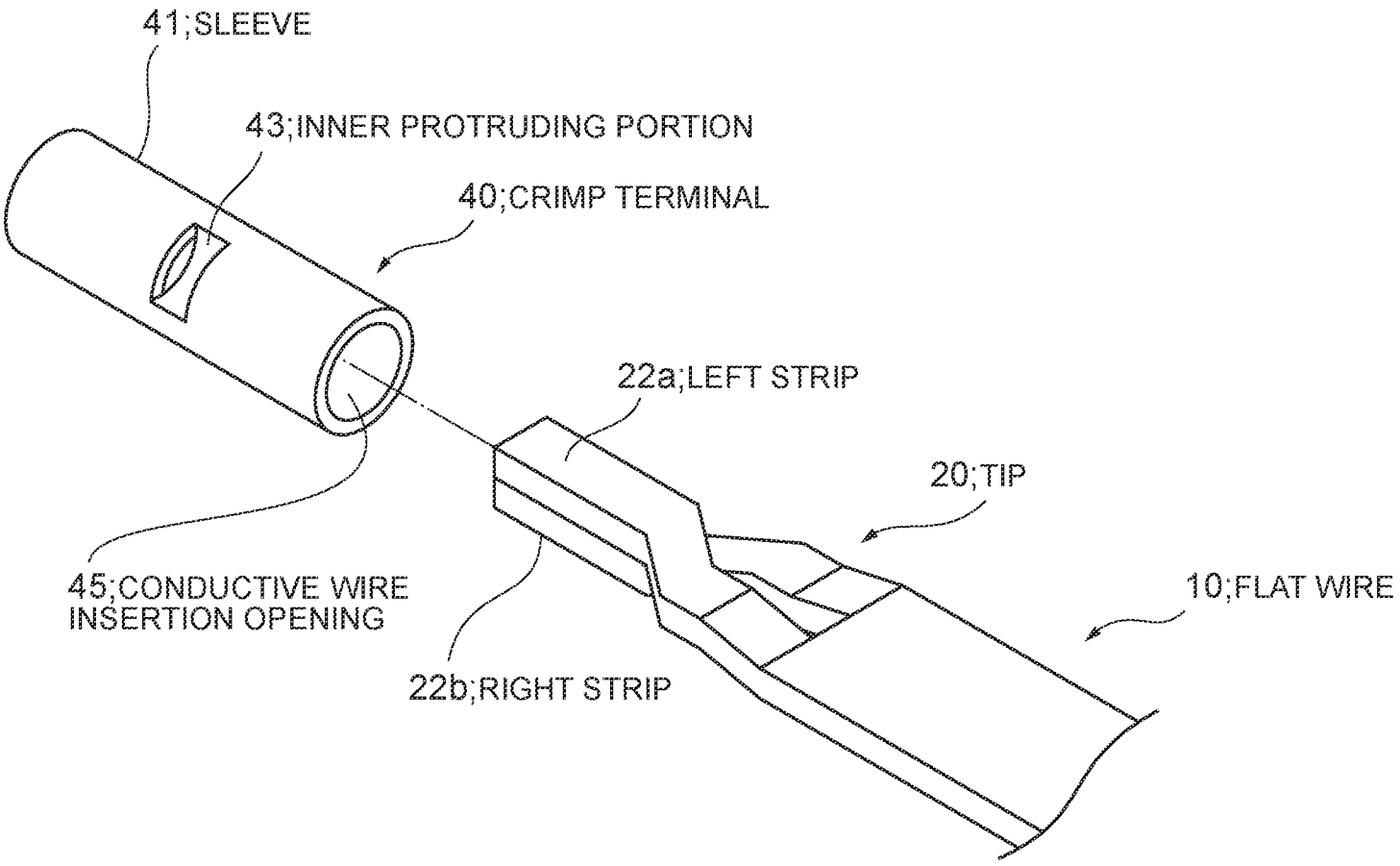
FIG. 3 is a schematic diagram of a tip structure of a flat wire according to an embodiment of the present invention, and joining between a tip and a crimp terminal.

FIG. 3 shows the tip 20 of the flat wire 10 being connected to the crimp terminal 40. Specifically, the flat wire 10 is a conductive wire having a rectangular section, and has a surface coated with an insulating coating such as enamel as described above. In crimping joining, the tip 20 of the flat wire 10 is inserted into a sleeve 41 that is made of copper (in principle, made of the similar material to that of the conductive wire) and forms a crimp terminal. The tip structure of this embodiment can be used to smoothly insert the tip 20 into the conductive wire insertion opening 45.

Various shapes of sleeves 41 may be used, but the sleeve 41 needs to include a tubular portion into which the tip 20 of the flat wire 10 can be inserted (including a portion that is not completely closed as a tube).

In a middle of the sleeve 41 in a longitudinal direction, an inner protruding portion 43 formed by protruding an outer peripheral surface of the sleeve 41 inward. Thus, when the tip 20 is inserted into the conductive wire insertion opening 45 of the sleeve 41, the inner protruding portion 43 can prevent the tip 20 from being further inserted.

As such, with the tip 20 of the flat wire 10 being inserted into the conductive wire insertion opening 45 of the sleeve 41 to a predetermined position, a predetermined region of the sleeve 41 closer to the conductive wire insertion opening 45 than the inner protruding portion 43 is deformed to be crushed, thereby ensuring a contact between an outer surface of the tip 20 (the insulating coating on the surface is previously peeled) and an inner wall of the sleeve 40 and ensuring an electrical conduction between the sleeve 41 and the tip 20. Since the slit 21 is provided in the tip 20 of the flat wire 10 and thus the insulating coating is partially peeled, the insulating coating can be easily previously peeled from the outer surface of the tip 20.

Figure 6:
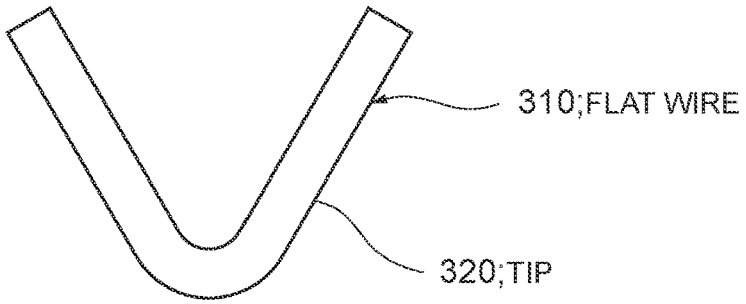
FIG. 6 is a schematic diagram of a tip structure of a flat wire according to a conventional technology (using V-shaped bending)
Figure 7:
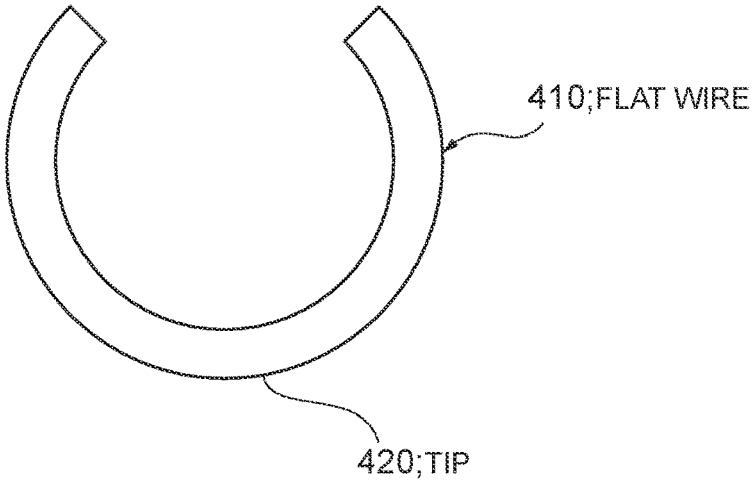
FIG. 7 is a schematic diagram of a tip structure of a flat wire according to a conventional technology (using round bending)

In the tip structure of a flat wire of this embodiment, there is no need to work the tip 20 of the flat wire 10 to have a V-shaped section or an arcuate section as in the conventional technologies (conventional technologies in FIGS. 6, 7), thereby reducing labor and cost. Also, if opposite sides of the tip 20 are removed by punching so that the flat wire 10 can be inserted into the conductive wire insertion opening 45 of the crimp terminal 40 as in the conventional technology (conventional technology in FIG. 8), tensile strength is reduced. However, in this embodiment, the strips 22*a*, 22*b* are overlapped to increase a thickness of the tip 20, thereby ensuring a sectional area of the tip 20 and ensuring tensile strength for the flat wire 10 originally having a small thickness.

Figure 4:
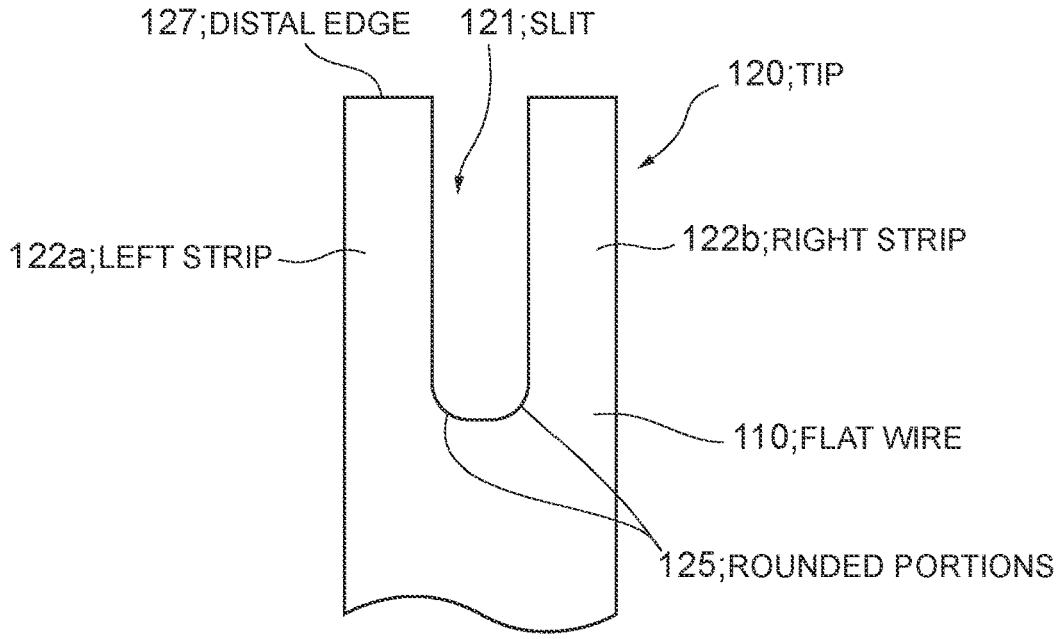
FIG. 4 is a schematic diagram of a variant of the tip structure of a flat wire according to the embodiment of the present invention.

FIG. 4 shows a variant of a slit shape with corners at a base of a slit 121 being formed as rounded portions 125. Members corresponding to predetermined members in the above embodiment are denoted by reference numerals assigned to the predetermined members with an addition of 100. When such a slit 121 is punched, both the corners at the base may be broken during punching. Thus, the corners formed as the rounded portions 125 prevent such a break.

Figure 5:
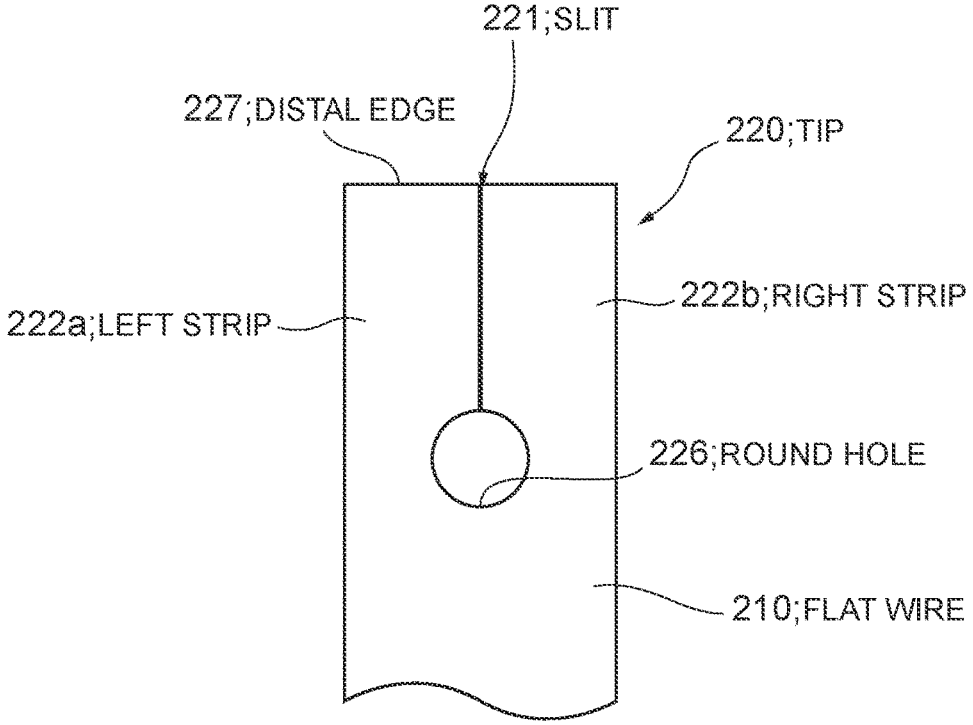
FIG. 5 is a schematic diagram of another variant of the tip structure of a flat wire according to the embodiment of the present invention.

As shown in FIG. 5, a slit 221 may be formed by simply making a cut having no width from substantially a middle of a distal edge 227. In FIG. 5, members corresponding to predetermined members in the above embodiment are denoted by reference numerals assigned to the predetermined members with an addition of 200.

In this case, a hole (round hole) 226 may be formed continuously with an inner end of the slit, thereby preventing a break from an inner end of the slit 221 and allowing strips divided by the slit 221 to be easily overlapped with each other.

The tip structure of a flat wire and the method for manufacturing the tip structure according to the present invention are not limited to those of the embodiment, but various other aspects may be applied.

For example, in the above embodiment, one of the left and right strips 22*a*, 22*b* divided by the slit 21 is pressed upward and the other is pressed downward so that the strips are vertically shifted by at least the thickness of the flat wire 10. However, the strips 22*a*, 22*b* may be twisted (tilted) by substantially the same angle in the same direction around longitudinal axes of the strips 22*a*, 22*b* so that the strips 22*a*, 22*b* are shifted from each other vertically (perpendicularly to an overlapping surface of the strips 22*a*, 22*b*) by at least a thickness of the strips 22*a*, 22*b*.

As such, the strips 22*a*, 22*b* are twisted (tilted) to facilitate working as compared to the above embodiment. The overlapping surface of the strips 22*a*, 22*b* is tilted with respect to the surface of the flat wire 10 by the angle of the twist, but this does not cause any problem in inserting the strips 22*a*, 22*b* into the sleeve 41 of the crimp terminal 40.

In the above embodiment, the strips 22*a*, 22*b* are substantially entirely overlapped, but may be partially overlapped as long as the overall width of the tip 20 can be reduced so that the tip 20 can be inserted into the sleeve 41 of the crimp terminal 40. A size of the overlapping region needs to be ensured so as to sufficiently keep tensile strength.

In the above embodiment, as shown in FIG. 1C, the strips 22*a*, 22*b* are vertically pressed to substantially abut against each other. However, the working of the tip 20 may be finished without the strips 22*a*, 22*b* being vertically pressed or with the strips 22*a*, 22*b* being vertically separated from each other, as long as the tip 20 can be inserted into the sleeve 41 of the crimp terminal 40. Specifically, there is no problem because the strips 22*a*, 22*b* are finally crushed in the sleeve 41 and substantially abut against each other.

The strips 22*a*, 22*b* do not necessarily have the same shape and may have different widths.

Figure 8:
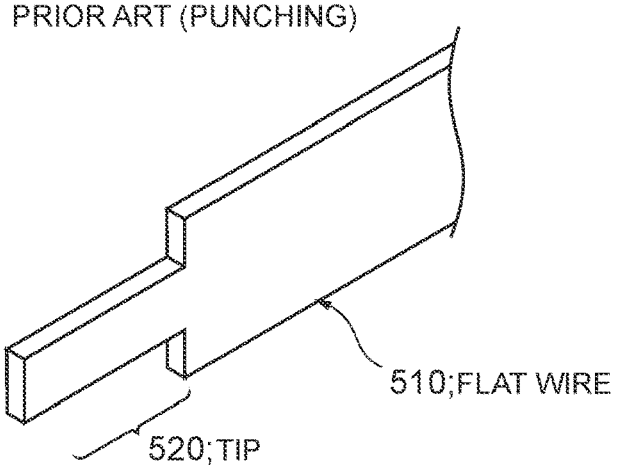
FIG. 8 is a schematic diagram of a tip structure of a flat wire according to a conventional technology (using punching)
Figure 9:
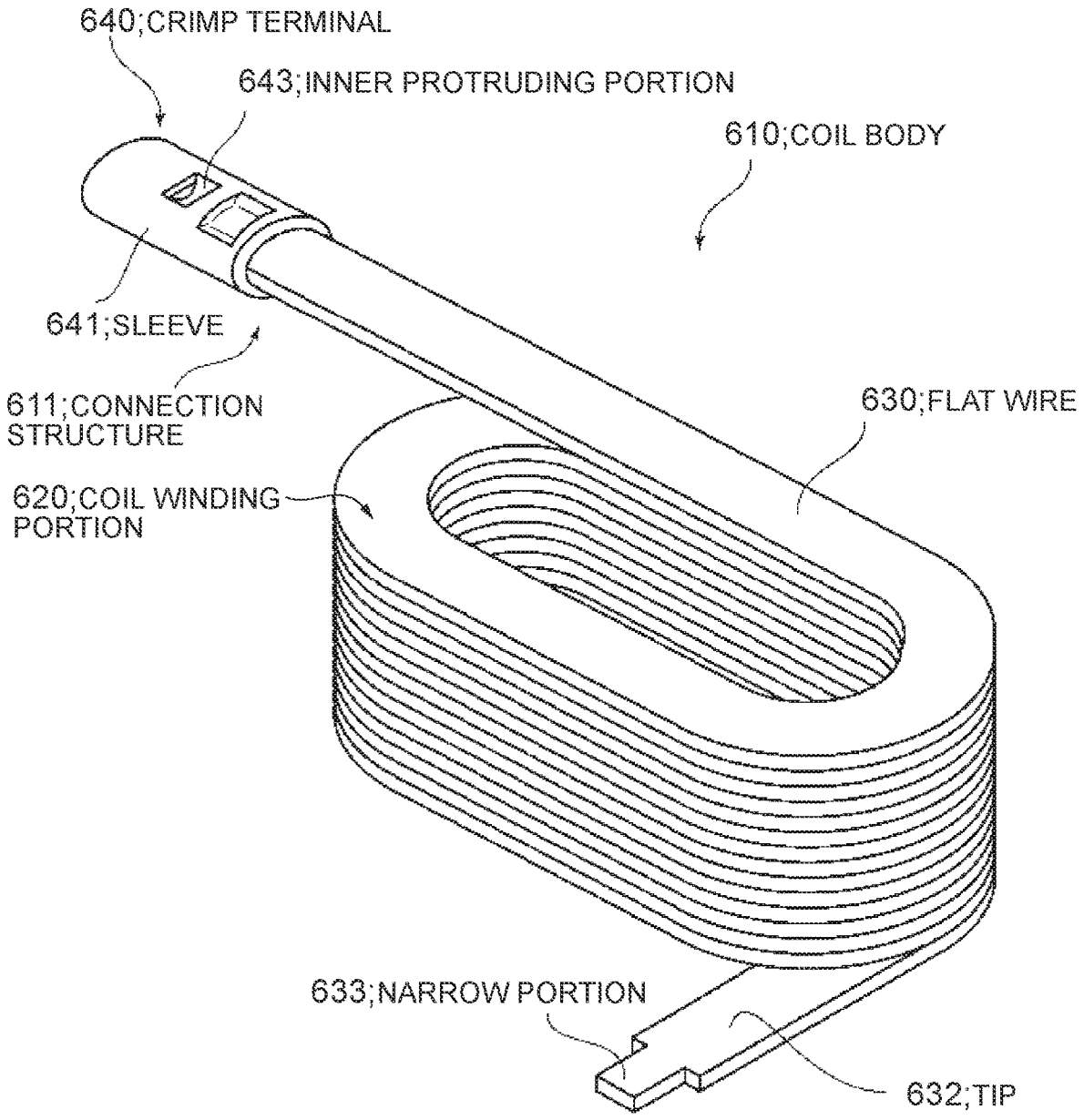
FIG. 9 PRIOR ART
FIG. 9 is a schematic diagram of a coil body formed by a conventional technology (punching).

In addition to the slit 21 being formed to overlap the strips 22*a*, 22*b*, opposite sides of the tip 20 may be cut off as shown in FIGS. 8 and 9.

The lateral pressing and vertical pressing of the strips 22*a*, 22*b* in the above embodiment may be performed by various well-known press machines.

What is claimed is:

1. A tip structure of a flat wire configured to allow the flat wire to be inserted into a conductive wire insertion opening of a crimp terminal when the flat wire is connected to the crimp terminal, the tip structure comprising:

one slit extending longitudinally from the distal end surface of the flat wire; and two strips extending from respective portions of a distal end surface of the flat wire to an endmost portion of the tip structure, the two strips having portions spaced from each other, by the slit, in a width direction of the tip structure, wherein the two strips vertically overlap each other at a location along a center axis of the tip structure, the center axis being an axis extending from a width center of the flat wire, the location including the endmost portion of the tip structure.

2. The tip structure of a flat wire according to claim 1, wherein a base of one of the two strips is spaced apart from a base of an other of the two strips.

3. The tip structure of a flat wire according to claim 1, wherein a base of one of the two strips abuts a base of an other of the two strips.

4. The tip structure of a flat wire according to claim 1, wherein the flat wire has a surface coated with an insulating coating.

5. A method for manufacturing a tip structure of a flat wire comprising:

when manufacturing the tip structure of the flat wire to be inserted into a conductive wire insertion opening of a crimp terminal to which the flat wire is to be connected, forming one slit extending longitudinally from the distal end surface of the flat wire;

forming two strips extending from respective portions of a distal end surface of the flat wire to an endmost portion of the tip structure, the two strips having portions spaced from each other, by the slit, in a width direction of the tip structure; and vertically overlapping the two strips at a location along a center axis of the tip structure, the center axis being an axis extending from a width center of the flat wire, the location including the endmost portion of the tip structure.

6. The method for manufacturing a tip structure of a flat wire according to claim 5, wherein the one slit has a predetermined width in a width direction of the flat wire.

7. The method for manufacturing a tip structure of a flat wire according to claim 6, wherein the one slit is formed by any one of punching, cutting with laser radiation, and cutting with a rotary knife.

8. The method for manufacturing a tip structure of a flat wire according to claim 6, wherein both corners at a base of the one slit are formed as rounded portions.

9. The method for manufacturing a tip structure of a flat wire according to claim 5, wherein the one slit is formed to have no width by a cutting line extending in the length direction of the flat wire.

10. The method for manufacturing a tip structure of a flat wire according to claim 9, wherein a hole is formed continuously with an inner end of the one slit.

11. The method for manufacturing a tip structure of a flat wire according to claim 5, wherein before the two strips are overlapped with each other, one the two strips is pressed upward and the other is pressed downward so that the two strips are shifted from each other vertically in the flat wire by at least a thickness of the flat wire.

12. The method for manufacturing a tip structure of a flat wire according to claim 11, wherein one of the strips is pressed upward and the other is pressed downward, and then the strips are laterally pressed to be close to each other.

13. The method for manufacturing a tip structure of a flat wire according to claim 12, wherein in laterally pressing the strips to be close to each other, bases of the strips are pressed toward a center by a first predetermined distance, and distal parts of the strips are pressed toward the center by a second predetermined distance.

14. The method for manufacturing a tip structure of a flat wire according to claim 5, wherein before the two strips are overlapped with each other, the two strips are twisted in the same direction around axes of the strips so that the strips are shifted from each other vertically in the flat wire by at least a thickness of the strips.

* * * * *